United States Patent [19]

Brausfeld et al.

[11] Patent Number: 4,656,457

[45] Date of Patent: Apr. 7, 1987

[54] POSITION-SENSING POTENTIOMETER ARRANGEMENT

[75] Inventors: Walter Brausfeld, Hanover; Helmut Göttling, Isernhagen; Rudolf Möller, Gehrden; Peter Müller, Hanover; Gerhard Scharnowski, Gehrden, all of Fed. Rep. of Germany

[73] Assignee: WABCO Westinghouse Steuerungstechnik GmbH, Hanover, Fed. Rep. of Germany

[21] Appl. No.: 783,979

[22] Filed: Oct. 3, 1985

[30] Foreign Application Priority Data

Oct. 5, 1984 [DE] Fed. Rep. of Germany ..... 3436560
Jun. 5, 1985 [DE] Fed. Rep. of Germany ..... 3520199

[51] Int. Cl.[4] ..... F01B 25/26

[52] U.S. Cl. ..... 338/176; 338/183; 338/233; 33/125 R; 91/1; 92/5 R

[58] Field of Search ..... 91/1; 92/5 R; 33/125 R; 338/176, 183, 233, 227

[56] References Cited

U.S. PATENT DOCUMENTS 3,572,214 3/1971 Woodward ..... 91/363 R X
3,726,191 4/1973 Johnston et al. ..... 92/5 R
4,523,514 6/1985 Burk ..... 92/5 R

*Primary Examiner*—Kenneth J. Ramsey
*Attorney, Agent, or Firm*—G. E. Hawranko

[57] ABSTRACT

A position-sensing potentiometer arrangement for sensing the position of a movable piston and piston rod configuration within a linear actuator includes a first support member extending longitudinally within an open-ended recess formed in the rod and a sliding contact mounted thereon. A tubular support is mounted to a stationary closed end of the linear actuator and extends into the recess to surround a portion of the first support member and a center support member which is also mounted on the closed end of the a actuator. A longitudinally-extending resistance element and a parallel conductor element are mounted on and supported by the center support member. As the first support member moves through the tubular support, the sliding contacts couple the resistance element to the conductor element to provide a resistance value variable as a function of the position of the piston rod. In the event of movement of the piston rod, other than longitudinal movement, the resistance element is isolated by the tubular support against contact by the piston rod.

15 Claims, 6 Drawing Figures

POSITION-SENSING POTENTIOMETER ARRANGEMENT

BACKGROUND OF THE INVENTION

This invention relates to a position-sensing potentiometer arrangement for sensing the position of a piston within a linear actuator, more particularly, a linear actuator such as a work cylinder which can be used, for example, to control the door-movement of a public transit vehicle where it is required to precisely determine the door position at any particular time. Such a work cylinder can also be used in other applications requiring a precise determination of the position of an object to be controlled by the work cylinder.

In order to determine each respective position of the piston to a precise degree, linear actuators have typically provided an inductance measuring arrangement wherein a coil is wound around a cylinder; such an arrangement proving to be costly in both the manufacturing and maintenance phases of operation. It is conceivable, however, to provide a linear actuator using a potentiometer-type measuring arrangement wherein a resistance element is secured to a stationary portion of the linear actuator and a sliding contact is secured to the movable piston rod. One example of a potentiometer-type measuring device can be found in U.S. patent application Ser. No. 647,092, which has matured into U.S. Pat. No. 4,566,196 assigned to the assignee of the present invention. The invention contained therein, however, is directed toward an externally attachable position measuring arrangement, and there are certain industrial and mechanical applications where space requirements are such that the position-sensing arrangement occupies very little space in addition to that of the work cylinder. In work cylinder applications adhering to strict external space requirements, it is still necessary to provide a precise position indication, even where the piston stroke can be very large. With the stroke of the piston, sliding contacts mounted on a rod-shaped support must be moved along the path of the resistance element between the two end points of the resistance element. With each change of the distance of the sliding contacts to the two resistance points, the voltage picked up by the potentiometer will change, thus indicating the position.

If the work cylinder has a great overall length, the position-sensing potentiometer arrangement must have a great overall length as well. This means that the resistance element and the support, in the form of a rod for the sliding contact, must have a length that corresponds to the maximum length of the piston. Due to the greath length of the support for the sliding contact, it could happen that the support bends and partially rests upon the resistance surface. The function of the potentiometer would be greatly affected by this circumstance. It is possible, of course, to achieve greater rigidity of the support by dimensioning the cross-section of the support accordingly. However, this would be associated with an undesirable, and for many applications, no longer acceptable, enlargement of the entire potentiometer. Additionally, such dimensioning would increase the weight of the device, thereby affecting the force and time-efficiency of the overall work cylinder.

SUMMARY OF THE INVENTION

It is, therefore, an object of the invention to provide a position-sensing potentiometer arrangement for a linear actuator, wherein the position-sensing potentiometer arrangement does not adversely affect the size requirements for mounting the linear actuator.

It is yet a further object of the invention to provide such a position-sensing potentiometer arrangement of a simple design and where, with simple means, a sagging of the support for the sliding contact or of the support for the resistance element will be prevented.

It is an even further object of the invention to provide such a position-sensing potentiometer arrangement for a linear actuator, wherein the position-sensing potentiometer arrangement does not adversely load nor affect the operation of the piston and piston rod elements of the linear actuator.

It is still a further object of the invention to provide such a position-sensing potentiometer arrangement which includes a movable joint between the support for the sliding contacts and the support for the resistance element such that, the potentiometer is protected from damage from the piston rod return.

Briefly, the invention consists of a linear actuator having a reciprocally-movable piston disposed therein, and a piston rod extending from the piston outward of a cylinder housing for attachment to the device to be controlled thereto. A tubular support body is secured to a closed end of the housing and extends into a recess formed in the piston rod. This tubular support body surrounds and protects a resistance element which extends longitudinally for a distance substantially corresponding to the stroke of the piston. A conductor, disposed parallel to the resistance element and also within the tubular support body, is electrically-coupled to the resistance element by sliding contacts disposed on a support rod which is secured internally to the piston rod for movement therewith. As the piston rod moves, the point along the resistance element at which the conductor will be coupled changes, and thus indicates the position of a piston by the change in resistance associated therewith. A flexible coupling serves to secure the support rod to the piston rod and still allow movement in a direction opposed to the longitudinal traveled piston rod without adversely affecting the connection between the resistance element and the conductor established through the sliding contacts.

DESCRIPTION AND OPERATION

Figure 1:
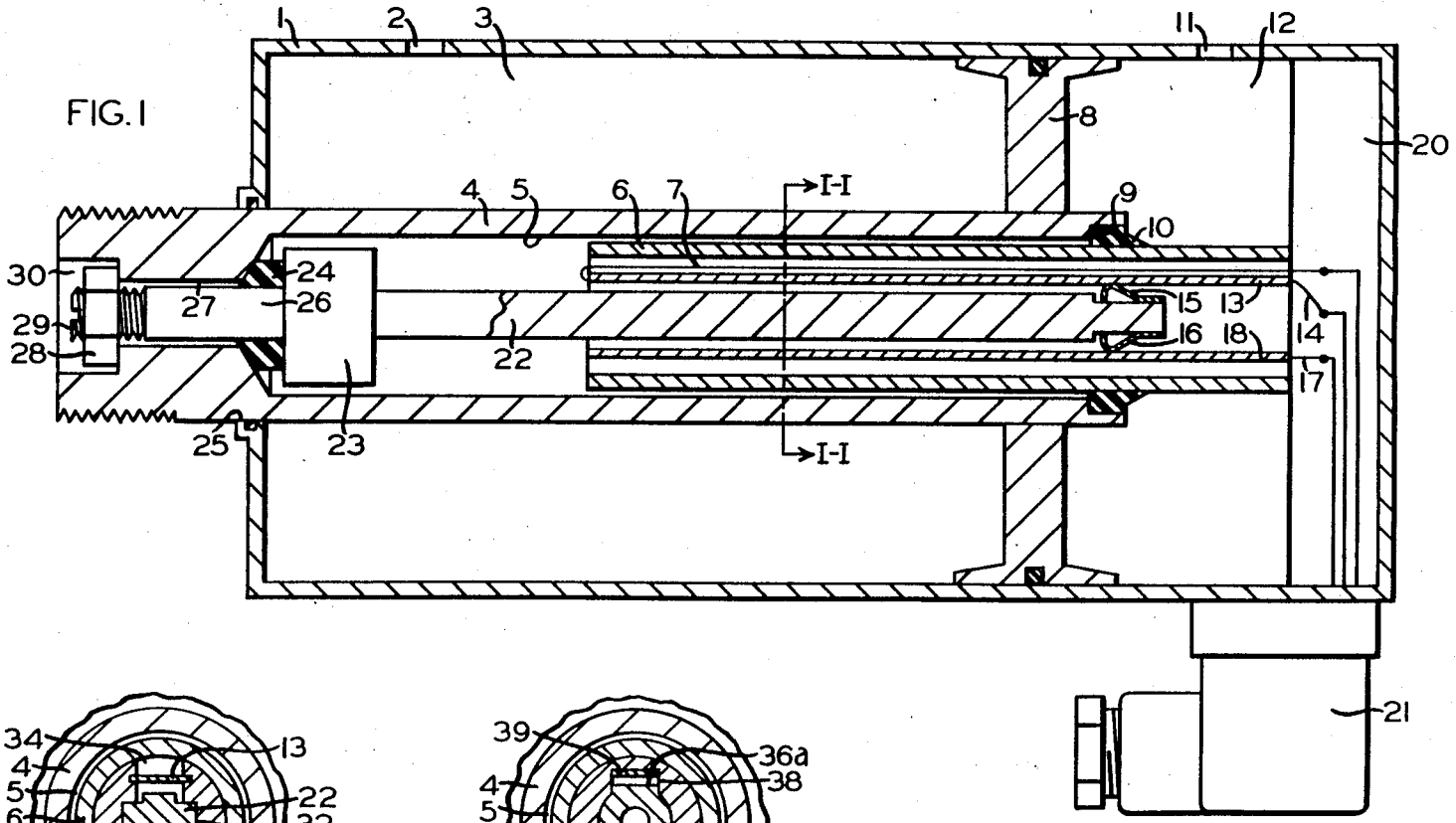
FIG. 1 is an elevational view, in section, of a work cylinder having a position-sensing potentiometer arrangement constructed in accordance with the invention.

FIG. 1 shows a potentiometer-type position-sensing work cylinder 1 in which a piston 8, connected to a piston rod 4, reciprocally moves and is sealed off. The piston 8 divides the work cylinder 1 into a first pressure chamber 3 on the piston rod side and a second pressure chamber 12, which is opposite the first pressure chamber 3 and is located on the opposite side of piston 8. Each of the first and second pressure chambers 3, 12 can be connected with a fluid pressure source (not shown) via a first and second pressure connection 2, 11, respectively, and a valve device (not shown).

The piston rod 4 has, running in the direction of its longitudinal axis, a rod recess 5 (preferably cylindrical) which starts at the end of the piston rod 4, extending into the work cylinder 1, and continues in the fashion of a blind bore in a direction toward the end segment of the piston rod 4 which is brought out of the work cylinder 1 through a rod opening 25 provided in the cylinder bottom. The piston 8 and the piston rod 4 are of such design and coupled in such a way that the end of the piston rod 4, which is within the work cylinder 1, passes coaxially through the piston 8.

At the opposite end or closed end 20 of the work cylinder 1, a tubular support body 6 is mounted stationary, coaxially relative to the movable piston rod 4, which tubular support body 6 extends into the recess 5 of the piston rod 4. A rod sealing element 10, located in a rod groove 9 of piston rod 4, encloses the tubular support body 6 and, in this manner, seals the rod recess 5 of the piston rod 4 from the second pressure chamber 12. Within the tubular support body 6, there is a support 19 which serves to constrain a resistance element 13, disposed in the manner of a resistance plate and a conductor 18. The conductor 18 is disposed substantially parallel and in a spaced-apart relation from the resistance element 13.

Figure 2:
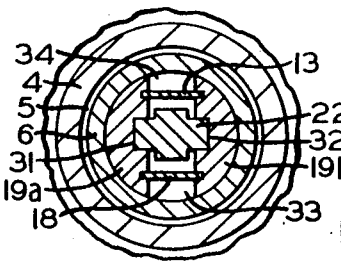
FIG. 2 is an elevational view, in section, of a work cylinder having a position-sensing potentiometer arrangement taken along lines I—I of FIG. 1.

As shown in FIG. 2, the support 19 may consist of two similar parts 19*a* and 19*b*, which are in a symmetrical configuration to one another. The outer contour of the support parts 19*a* and 19*b* are adapted to the inside wall of the tubular support body 6. As further shown in FIG. 2, support grooves 31 and 32 are provided in the support 19 and run in the direction of the longitudinal axis of the support 19 and serve to guide a rod-shaped support rod 22 on which is disposed first and second sliding contacts 15, 16. The first and second sliding contacts 15, 16 are mounted on the end of the support rod 22, which extends towards the closed end 20 of the work cylinder 1. The resistance element 13 and the conductor 18 are oriented parallel to the longitudinal axis of the support rod 22 and are inserted in the corresponding support grooves 31, 32 of the support parts 19*a* and 19*b*; and their configuration, relative to the support rod 22, is such that the resistance element 13 interacts with the first sliding contact 15 and the conductor 18 interacts with the second sliding contact 16. The support rod for the sliding contacts 15, 16 has, as shown in FIG. 2, an approximately cross-shaped profile and, at its free end, features a graduated portion to hold the sliding contacts 15, 16 which rest with spring-action against the resistance element 13 and the conductor 18. The end of the support rod 22 opposite the sliding contacts 15, 16, is connected via a flexible coupling 23, with a bolt 26 which is guided in a through bore 27 of the piston rod 4 that is adjacent to the rod recess 5 of the piston rod 4.

Into the free end section of the bolt 26, a thread 29 is cut onto which is screwed a nut 28. The nut 28 is in a counterbore 30 of the piston rod 4. Between the flexible coupling 23 and a conically-shaped end 5*a* of the piston rod 4, which bounds the rod recess 5, there is an elastic body 24 which is located between the flexible coupling 23 and the concial end 5*a* such that compensation or play can exist therebetween. Electrical coupling lines 7, 17 and 14 are connected to the two ends of the resistance element 13 and the conductor 18 and are then coupled to a plug 21 which can be disposed on the work cylinder 1.

Figure 3:
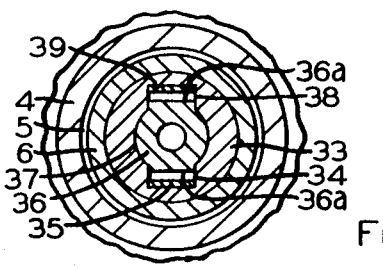
FIG. 3 is an elevational view, in section, of an alternate embodiment of a work cylinder having a position-sensing potentiometer arrangement taken along lines I—I of FIG. 1.

FIG. 3 illustrates an alternate arrangement for supporting the resistance element 13 and conductor 18 within the tubular support body 6. The support for the resistance element 13 and the conductor 18 or, respectively, the guide for an alternate or arcuately-shaped rod support 36 for the sliding contacts 15, 16 is designed as a tubular body 33. At the inside bore 37 of the tubular body 33, two alternate opposing support grooves 34 and 38 are provided, which run in a longitudinal direction of the tubular body 33, with the resistance element 13 being located on the groove base of the first alternate support 38 and the conductor 18 on the groove base of the second alternate support 34. The arcuate rod support 36 for the sliding contacts 15, 16 is adapted to the contour of the inner wall of the tubular body 33 and features two opposing projections 36*a* that engage the alternate support grooves 34, 38.

The respective support projections 36*a*, provided in the support for the resistance element 13 and the conductor 18, as well as the tubular body 33 for the sliding contacts 15, 16, are intended to prevent a twisting motion of the arcuate rod support 36 into tubular body 33 such that twisting is also prevented between the resistance element 13 and the conductor 18 and the sliding contacts 15, 16. Any type of mated profile may be used for the sliding contact or tubular body support 33, which prevents a torsional motion between the tubular body 33 and the arcuate rod support 36 for the resistance element 13 and which can be easily sealed.

In order to make possible a twisting motion or a shifting motion, respectively, of the piston rod 4 versus the work cylinder 1 and the potentiometer arrangement, the flexible coupling 23 is provided between the bolt 26, 29 and the support rod 22 for the sliding contacts 15, 16.

In operation, it is being assumed that via the second pressure connection 11, fluid pressure is introduced into the second pressure chamber 12. The fluid pressure building in the second pressure chamber 12 urges the piston 8 toward the left in the direction of the first pressure chamber 3, as shown in FIG. 1. Via the first pressure connection 2 and the valve device (not shown), the fluid pressure in the first pressure chamber 3 is being exhausted to atmosphere. The piston 8 carries along the piston rod 4 and the support rod 22 for the sliding contacts 15, 16, which are connected to the piston rod 4. The sliding contacts 15, 16 are passed by the resistance element 13 and the conductor 18 in the piston's direction of movement. Due to the telescope-type design and the mutual configuration of the arcuate rod 36 and the tubular body 33, support for the resistance element 13 and the conductor 18, as well as for the sliding contacts 15, 16, the rod support 36 and the tubular body 33 are guided or supported, respectively, over the entire length or at least the major portion of the entire length and on at least part of the cross-sectional circumference.

By changing the location of the first and second sliding contacts 15, 16, and thus the pick-up point along the resistance element 13, a change of the voltage picked up by the resistance element 13 is achieved. The tapped voltage is passed to an evaluation circuit (not shown) which determines the piston position thereby using known methods, and sends signals corresponding to that respective piston position.

Figure 4:
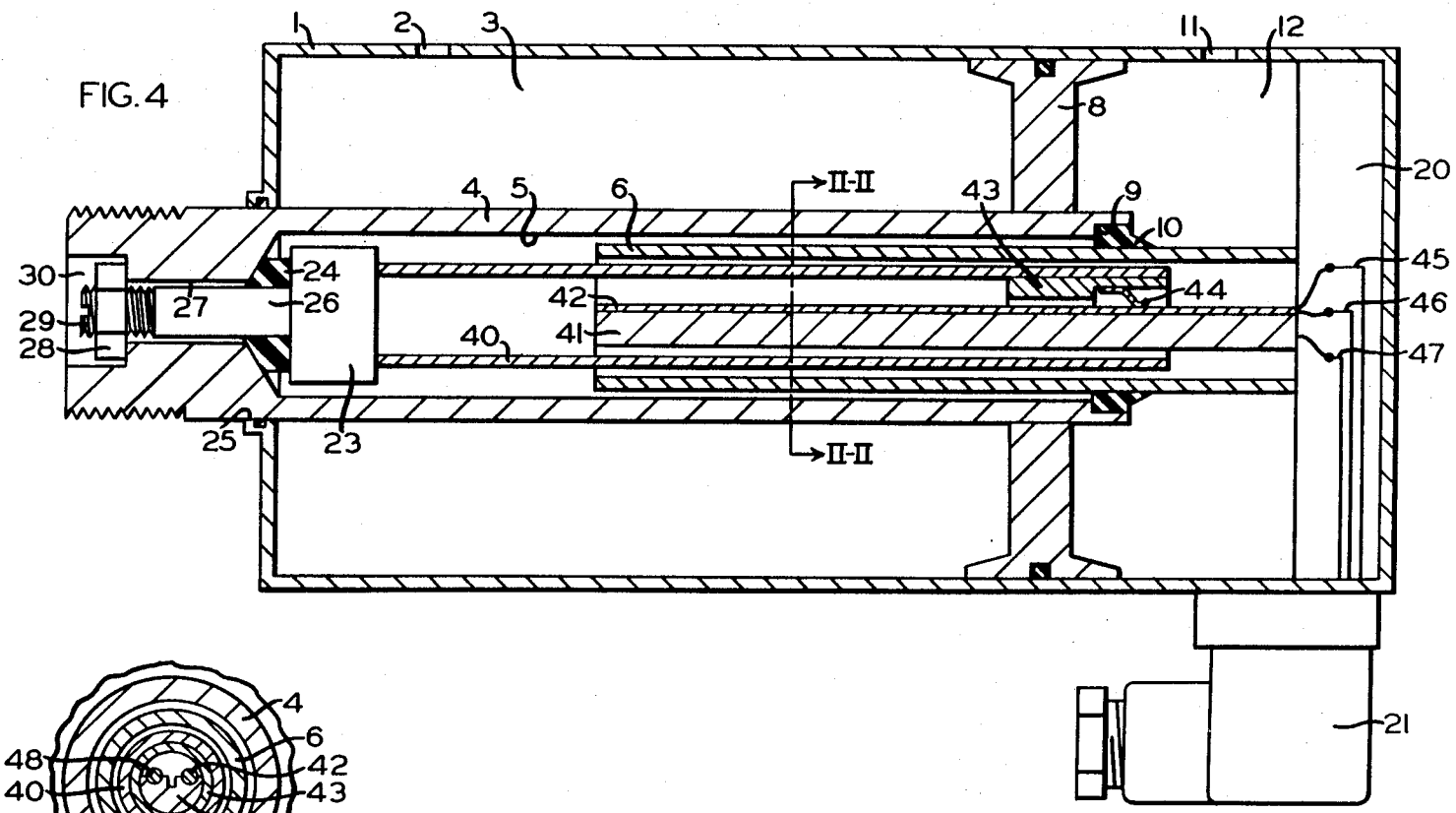
FIG. 4 is an elevational view, in section, of an alternate embodiment of a work cylinder having a position-sensing potentiometer arrangement.

As shown in FIG. 4, a second alternate embodiment of the support arrangement for the resistance element 13 and conductor 18 is provided for the potentiometer-type position-sensing work cylinder 1.

For the sake of clarity, those components which are the same as those in FIG. 1 carry the same reference symbols. As in the case of the work cylinder 1, as per FIG. 1, the piston rod 4 has a rod recess 5 extending in the direction of its longitudinal axis. Mounted at the flexible coupling 23 within the rod recess 5 is a support tube 40 for two conductively-connected, side-by-side mounted sliding contacts 44. The support tube 40 is designed such that, in its free end section, a contact mounting 43 with a sliding contact 44 is provided. The support tube 40 is arranged coaxially to another tubular body 6 attached at the bottom or closed end 20 of the work cylinder 1. The tubular body 6 and the support tube 40 serve as support for the sliding contacts 44 as they are telescopically moved through the work cylinder 1 in conjunction with the piston rod 4. Within the tubular body 6, there is provided a plastic semicircularly-shaped support 41 for a resistance element 42 and a conductor 48 that are adjacent to each other and run parallel to the longitudinal axis of the semicircular support 41. This semicircular support 41 is attached at the closed end 20 of the work cylinder 1 and extends into the support tube 40 which houses the sliding contacts 44. The contact mounting 43 for the sliding contacts 44 is designed so that it surrounds the semicircular support 41 and, during a sliding motion of the sliding contacts 44, supports the semicircular support 41 for the resistance element 42 and the conductor 48, each within the range being traversed by the sliding contacts 44. Electrical coupling lines 45, 46, 47 lead from the resistance element 42 and conductor 48 to a plug secured to the work cylinder 1. The piston rod recess 5 is sealed versus the second pressure chamber 12 by means of a rod seal 10, located between the wall of the piston rod 4 bounding the piston recess 5 and the surface of the tubular body 6.

Figure 5:
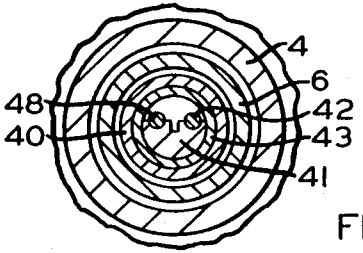
FIG. 5 is an elevational view, in section, of an alternate embodiment of a work cylinder having a position-sensing potentiometer arrangement taken along lines II—II of FIG. 4.

FIG. 5 shows a section through the piston rod 4, the two telescopically interacting support tubes 6 and 40, as well as the semicircular support 41 for the resistance element 42 and conductor 48. The semicircular support 41 for the resistance element 42 and the conductor element 48 have a semicircular cross-section with a straight surface supporting the resistance element 42 and the conductor 48 in their side-by-side orientation. The function of the work cylinder 1 (shown in FIGS. 4 and 5) is identical to the function of the work cylinder 1 described in FIG. 1) and will not be further discussed.

Another embodiment of the invention includes the potentiometer portion (shown in FIG. 6) wherein an external guide tube 51 which, with its one end, is screwed into a graduated opening 67, 63 of a retaining member 60. An annular seal 59, disposed in the inner wall bounding the graduated opening 67, 63, closes off the gap between the surface of the guide tube 51 and the inner wall bounding the graduated opening 67, 63. In the area of the other end of the guide tube 51, there is a second retaining member 49 for the potentiometer portion which, in this embodiment, encircles the guide tube 51. Between the external surface of the guide tube 51 and the second retaining element 49, there is also a second annular seal.

Figure 6:
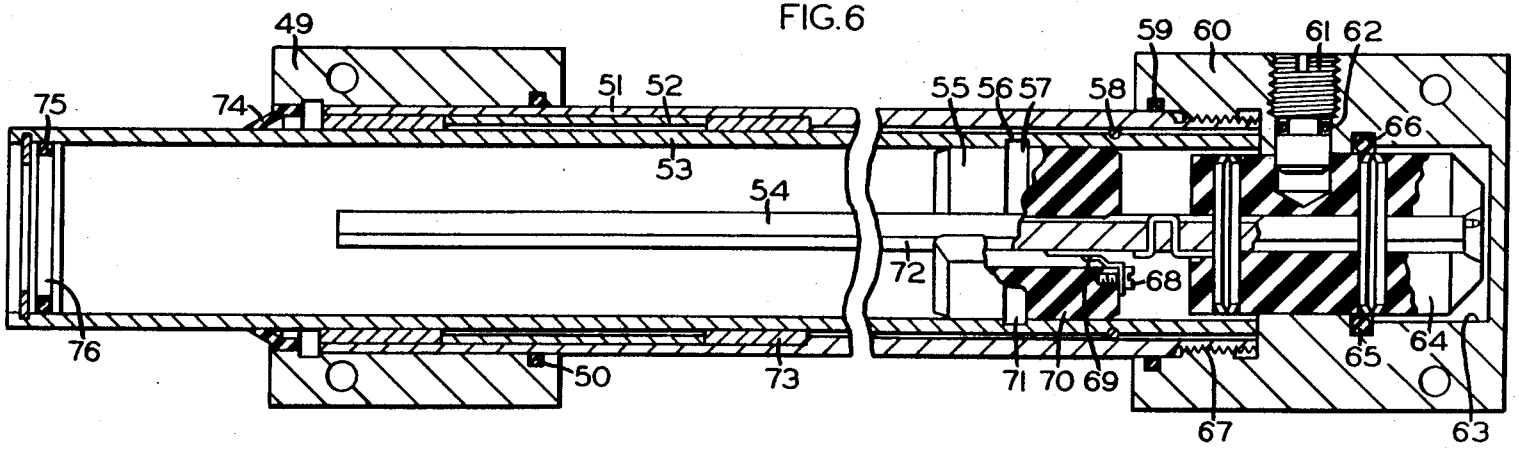
FIG. 6 is an elevational view, in section, of a second alternate embodiment of a linear actuator having a position-sensing potentiometer arrangement.

Inserted into the guide tube 51 is a tubular support body 53 which serves to support the sliding contact 69, the mounting of which will be described hereinafter in further detail. Mounted in an inner annular indention or graduated portion 73 of the guide tube 51 is a bushing 52, which serves as a guide for the tubular support body 53. In the end section of the tubular support body 53 within the guide tube 51, a stop ring 58 is mounted in a groove located in the surface of the tubular support body 53. During a movement of the tubular support body 53 away from the first retaining element 60, the stop ring 58 makes contact at the bushing 52, preventing an involuntary complete extraction of the tubular support body 53 from the guide tube 51. It will be noted that the actuator as shown in FIG. 6 provides that the end of the tubular support member 53 extending outward of the second retaining member 49 can be attached to another device (not shown) for which it is desired to measure the position. In other words, the actuator shown in FIG. 6 can be retrofit onto an existing device (not shown) which could include an independent piston and rod arrangement (not shown) instead of such an arrangement being included with the actuator. Attached to the free end of the guide tube 51 is a scrapper ring 74, which rests on the surface of the tubular support body 53, and thus prevents dirt from penetrating into the inside chamber of the potentiometer arrangement. The tubular support body 53, at its end projecting out from the guide tube 51, is closed off by a cover 76 with the help of an intermediate sealing ring 75. In the reduced recess portion 63 of the graduated opening 63, 67, located in the first retaining element 60, there is a mounting member 64 for a center support rod 54 featuring a resistance element 72. The center support rod 54 for the resistance element 72 extends into the tubular support body 53 to establish a sliding contact by which movement of the center support body 54 is used to derive the piston position thereby. In order to prevent an unplanned shift of position for the mounting member 64, and thus also for the center support rod 54 on which the resistance element 72 is secured, the mounting member 64 is fixed against movement both in the transverse and longitudinal directions by means of a screw 61 with a seal 62 to the first retaining element 60.

Within the tubular support body 53, there is located a molded element (which in this case can be plastic) that serves as a connecting element 55, 70 between the sliding contact 69 and the tubular support body 53, and which is divided in the direction of the longitudinal axis of the center support rod 54. Each of the two components of the connecting element 55, 70 has a central recess oriented in the direction of its longitudinal axis, which is essentially adapted to the contour of the center support rod 54 on which the resistance element 72 is mounted, so that it is not possible that the connecting elements 55, 70 and thus also the sliding contact 69, could become twisted relative to the center support rod 54 or could be moved transverse to the longitudinal axis of the center support rod 54. At the periphery of each of these two connecting components 55, 70, a bead-like projection 57 and 71, respectively, is provided, which engages in a continuous guide groove 56 formed in the inner wall of the tubular support body 53. The dimensions of the recesses in the first and second connecting elements 55, 70 are such that, the two elements are lightly pressed outward against the wall of the tubular support body 53 such that the sliding contact by the center support rod 54 in which the resistance element 72 is mounted is substantially supported thereby in the longitudinal direction. This measure ensures that, in the case of a relative movement between the center support rod 54 containing the resistance element 72 and the tubular support body 53 on which is coupled the sliding contact 69 via the first and second connecting elements 55, 70 in the direction of their longitudinal axis, the first and second projections 57, 71 of the first and second connecting elements 55, 70 will not jump out of the guide groove 56. The sliding contact 69 is designed as an angled flat spring, which is screwed with a contact screw 68 to the face of the second connecting member 70. The space serving to accept the contact screw 68 in the sliding contact 69 is in the shape of a slot, so that the initial tension with which the sliding contact 69 is to rest on the resistance element 72 can be modified by moving the sliding contact 69 toward the resistance path or away from same, respectively.

The assembly of the potentiometer arrangement (described in the preceding embodiment) takes place in such a manner that first, the center support rod 54 which includes the resistance element 72, is inserted with its mounting member 64 into the reduced-diameter portion 63 of the first retaining device 60 and fastened with a screw 61. Introduced into the tubular support body 53 for the sliding contact 69 are the two connecting elements 55, 70 for a length until the respective first and second projections 57, 71 extend into the guide groove 56 of the tubular support body 53. With the help of an appropriate tool, the first and second connecting elements 55, 70 are retained in the tubular support body 53. The center support rod 54, which has the resistance element 72 mounted thereon, is then introduced into the recess of the first and second connecting elements 55, 70, which causes the two connecting elements 55, 70 to be forced slightly against the inner wall of the tubular support body 53. The tubular support body 53 is slipped onto the mounting of the center support rod 54, which contains a resistance element 72, until it comes to rest at the point of graduation of the graduated opening 63, 67, formed in the first retaining element 60. The guide tube 51, with the second retaining element 49, is then slid onto the tubular support body 53 and screwed with the end section facing the first retaining element 60 into the larger portion 67 of the graduated opening 63, 67, which is threaded to accept the complementarily threaded end of the tubular support body 53. The connecting elements 55, 70 between the tubular support body 53 and the sliding contact 69, can be one single unit and have a slotted recess running in a direction of its longitudinal axis to accept the center support rod 54. This unitary-type of design for the connecting element has the advantage that the connecting element can be introduced into the tubular support body 53 with slight initial tension so that upon reaching the guide groove 56 in the tubular support body 53, the continuous projection located on the circumference of the connecting element will automatically catch the guide groove 56.

Although the hereinabove forms of the invention constitute preferred embodiments, it can be appreciated that modifications can be made thereto without departing from the scope of the invention as detailed in the appended claims.

For example, in order to prevent the generation of backpressure between the telescopically interacting tubes, it is also possible to modify the invention by including a check valve which may be provided via which the space enclosed by the two telescopic tubes can be evacuated into into the pressure chamber or toward atmosphere.

Additionally, the support carrying the resistance element or the sliding contact may be adjustable transverse to its longitudinal axis on its mount; that is, at the cylinder bottom.

Having thus described the invention, what we claim as new and desired to secure by Letters Patent, is:

1. A position-sensing potentiometer arrangement for sensing the position of a movable piston and piston rod configuration within a linear actuator comprising:

(a) a rod recess formed coaxially in the piston rod and having a rod opening facing a closed end of the linear actuator;

(b) at least one sliding contact secured to a first support member extending within said rod recess in a spaced-apart relation to an inner wall of said rod recess, said at least one contact being secured to said first support member at a point substantially corresponding in position to said rod opening;

(c) resistance means secured to and extending from the closed end of the linear actuator and in contact with said at least one sliding contact for providing a measurable resistance value which varies as a function of the piston rod position, such measurable resistance value corresponding to one of a range of predetermined resistance values associated with a range of such piston rod positions, said resistance means including a resistance element extending approximately the length equivalent to the length of travel of the piston rod, and a conductor element extending the approximate length of said resistance element;

(d) resistance support means secured to the closed end of the linear actuator and extending into at least a portion of said rod recess, said resistance support means further surrounding at least a portion of said resistance means for protecting said resistance means from contact by the piston rod and for supporting said resistance means in a stationary manner;

(e) said resistance element being disposed parallel to said conductor element, said first support member having said at least one sliding contact secured thereon is movable adjacent thereto such that said at least one sliding contact electrically couples said resistance element to said conductor element at approximately the position of said rod opening; and (f) said resistance support means including a tubular support member secured to the closed end of the linear actuator and surrounding at least a portion of said first support member.

2. A position-sensing potentiometer arrangement, as set forth in claim 1, wherein said first support member fits into said resistance support means in a telescoping, extending manner and said resistance support means fits into said rod recess in a telescoping, extending manner.

3. A position-sensing potentiometer arrangement, as set forth in claim 1, further comprising a rod seal disposed on said rod opening around said resistance support means.

4. A position-sensing potentiometer arrangement, as set forth in claim 1, wherein said resistance support means further includes a center support member to which is fixedly-secured, said parallel-disposed resistance and conductor elements, said center support member being contoured on its outer edge to the inner contour of said tubular support member and being contoured on its inner surface to receive, in a sliding manner, said first support member.

5. A position-sensing potentiometer arrangement, as set forth in claim 4, wherein said first support member is cross-shaped and two opposing sides of said cross-shaped first support member extend in a fitted-relation into complementary guide grooves formed in said center support member.

6. A position-sensing potentiometer arrangement, as set forth in claim 5, further comprising a flexible coupler disposed between the end of said first support member opposite to said at least one contact and the end of said rod recess opposite said rod opening, said flexible coupler being effective such that, such measured resistance value is provided even in the event of an undesired rotation of the piston rod relative to said resistance element.

7. A position-sensing potentiometer arrangement, as set forth in claim 4, wherein said first support member is essentially cylindrical in shape and having two symmetrically opposing projections which extend in a fitted-relation into complementary guide grooves formed in said center support member.

8. A position-sensing potentiometer arrangement, as set forth in claim 1, wherein said resistance support means further includes a center support member which is essentially semicircular in shape and has formed on its straight-sided diagonal, two parallel grooves in which are disposed said parallel resistance and conductor elements.

9. A position-sensing potentiometer arrangement, as set forth in claim 8, wherein said first support member is essentially tubular in shape and surrounds a portion of said center support member, said first support member having a contact-mounting element disposed therein such that said at least one sliding contact can be mounted thereon.

10. A position-sensing potentiometer arrangement, as set forth in claim 9, wherein said center support member has an arcuately-shaped outer contour which rests in and is supported by said tubular-shaped first support member, and further, wherein said resistance and said conductor elements rest on and are supported by said straight-sided diagonal of said center support member such that said at least one sliding contact can be moved thereover.

11. A position-sensing potentiometer arrangement, as set forth in claim 10, further comprising a flexible coupler disposed between the end of said first support member opposite to said at least one contact and the end of said rod recess opposite said rod opening, said flexible coupler being effective such that, such measured resistance value is provided even in the event of an undesired rotation of the piston rod relative to said resistance element.

12. A position sensing potentiometer device for sensing the position of a movable member within a housing comprising:

(a) a recess formed coaxially in the movable member and having an opening facing a closed end of the housing;

(b) at least one sliding contact secured to a first support member extending within said recess in a spaced-apart relation to an inner wall of said recess, said at least one contact being secured to said first support member at a point substantially corresponding in position to said opening;

(c) resistance means secured to and extending from said closed end of the housing and in contact with said at least one sliding contact for providing a measurable resistance value which varies as a function of the position of the movable member, such measurable resistance value corresponding to one of a range of predetermined resistance values associated with a range of such movable member positions, said resistance means including a resistance element the length of travel of the movable member, and a conductor element extending the approximate length of said resistance element;

(d) resistance support means secured to said closed end of the housing and extending into at least a portion of said recess, said resistance support means further surrounding at least a portion of said resistance means for protecting said resistance means from contact by the movable member and for supporting said resistance means in a stationary manner;

(e) said resistance element being disposed parallel to said conductor element, said first support member having said at least one sliding contact secured thereon is movable adjacent thereto such that said at least one sliding contact electrically couples said resistance element to said conductor element at approximately the position of said rod opening; and (f) said resistance support means including a tubular support member secured to the closed end of the housing and surrounding at least a portion of said first support member.

13. A position-sensing potentiometer arrangement, as set forth in claim 12, wherein said resistance support means includes a resistance mounting member secured against rotation within the closed end of said housing and having a coaxial slot formed therein through which is secured one end of a center support member, said center support member extending into said recess at the opposite end thereof and having mounted thereon said resistance and said conductor elements.

14. A position-sensing potentiometer arrangement, as set forth in claim 13, wherein said first support member is formed by at least two similarly-formed connecting elements, said connecting elements, when joined, having a center slot through which said center support member extends and having mounted thereon said at least one sliding contact, said center support member cooperatively engaging said at least two connecting members such that said connecting members are urged outward against the inner wall of said recess.

15. A position-sensing potentiometer arrangement, as set forth in claim 14, wherein complementary guide projections formed on said at least two connecting elements engage complementary guide grooves formed in said rod recess such that, said at least two connecting elements are prevented from moving rotationally relative to said resistance element.

* * * * *